US007221348B2

(12) United States Patent
Ogawa

(10) Patent No.: US 7,221,348 B2
(45) Date of Patent: May 22, 2007

(54) LIQUID CRYSTAL DISPLAY DEVICE AND METHOD FOR DRIVING THE SAME

(75) Inventor: Yasunori Ogawa, Tokyo (JP)

(73) Assignee: NEC Viewtechnology, Ltd., Tokyo (JP)

( * ) Notice: Subject to any disclaimer, the term of this patent is extended or adjusted under 35 U.S.C. 154(b) by 306 days.

(21) Appl. No.: 10/458,268

(22) Filed: Jun. 11, 2003

(65) Prior Publication Data

US 2003/0231155 A1 Dec. 18, 2003

(30) Foreign Application Priority Data

Jun. 12, 2002 (JP) ..... 2002-172039

(51) Int. Cl.
*G09G 3/36* (2006.01)

(52) U.S. Cl. ..... 345/89; 345/211

(58) Field of Classification Search ..... 345/54, 345/87–90, 211

See application file for complete search history.

(56) References Cited

U.S. PATENT DOCUMENTS 5,621,439 A * 4/1997 Okada et al. ..... 345/211
6,127,995 A * 10/2000 Furuhashi et al. ..... 345/96
6,128,045 A * 10/2000 Anai ..... 348/556
6,201,522 B1 * 3/2001 Erhart et al. ..... 345/96
6,310,616 B1 * 10/2001 Yanagi et al. ..... 345/211
6,320,562 B1 * 11/2001 Ueno et al. ..... 345/87
6,504,520 B1 * 1/2003 Osada et al. ..... 345/76
6,538,630 B1 * 3/2003 Tanaka et al. ..... 345/94
6,714,179 B1 * 3/2004 Waterman ..... 345/87
2002/0089473 A1 * 7/2002 Yamazaki et al. ..... 345/75.2
2002/0126076 A1 * 9/2002 Itakura ..... 345/87
2003/0122757 A1 * 7/2003 Bu ..... 345/87

FOREIGN PATENT DOCUMENTS

JP 2000-305063 A 11/2000

* cited by examiner

*Primary Examiner*—Amr A. Awad
*Assistant Examiner*—Michael Pervan
(74) *Attorney, Agent, or Firm*—Sughrue Mion, PLLC

(57) ABSTRACT

A liquid crystal display device is provided which is capable of reducing flicker over all areas of a liquid crystal panel. A common voltage having a predetermined level is fed to the liquid crystal panel and a reference voltage is fed from a digital-analog converter to a liquid crystal driving circuit and an image corresponding to a pixel data signal is displayed. The pixel data signal is reversed relative to a reference voltage for every one horizontal period. The reference voltage having been adjusted so as to be higher in side portions rather than central portions in the liquid crystal panel is applied to the liquid crystal driving circuit. As a result, even if a common voltage is not made uniform through entire portions of a common electrode, adjustment can be achieved so that flicker is minimized over all areas in the liquid crystal panel.

8 Claims, 10 Drawing Sheets

LIQUID CRYSTAL DISPLAY DEVICE AND METHOD FOR DRIVING THE SAME

BACKGROUND OF THE INVENTION

1. Field of the Invention

The present invention relates to a liquid crystal display device and to a method for driving the same and more particularly to the liquid crystal display device and the method the same that can be suitably used in a device such as a liquid crystal projector in which a screen of high quality with flicker being reduced is required.

The present application claims priority of Japanese Patent Application No. 2002-172039 filed on Jun. 12, 2002, which is hereby incorporated by reference.

2. Description of the Related Art

A conventional liquid crystal display device, in order to prevent deterioration of a liquid crystal material, is driven with an alternating current so that a polarity of a voltage to be applied to the liquid crystal material is alternately reversed at predetermined time intervals.

The conventional liquid crystal display device of this type, as shown in FIG. 11 for example, includes a liquid crystal panel 10, a liquid crystal driving circuit 20, and a common voltage generating circuit 30. The liquid crystal panel 10, as shown in FIG. 12, has a plurality of signal lines $X_1, X_2, \ldots, X_n$ to which a corresponding pixel data signal D is fed, a plurality of scanning lines $Y_1, Y_2, \ldots, Y_m$ to which a scanning signal V is fed, a plurality of MOSFETs (Metal Oxide Semiconductor Effect Field Transistors) $\mathbf{11}_{ij}$ (i=1, 2, . . . , n; j=1, 2, . . . , m) each being placed at a point of intersection of each of the signal lines $X_1, X_2, \ldots, X_n$ and each of the scanning lines $Y_1, Y_2, \ldots, Y_m$ pixels (picture elements) $\mathbf{12}_{ij}$ (i=1, 2, . . . , n; j=1, 2, . . . , m), capacitors $\mathbf{13}_{ij}$ (i=1, 2, . . . , n; j=1, 2, . . . , m), "Cs" line being commonly connected to each of the capacitors $\mathbf{13}_{ij}$, and a common electrode 14 being connected commonly to each of the pixels $\mathbf{12}_{ij}$ and to which a common voltage Vcom (FIG. 11) is applied, in which an image is displayed by a pixel data signal D fed to the pixels $\mathbf{12}_{ij}$ on the scanning lines $Y_1, Y_2, \ldots, Y_m$ to be selected by the scanning signal V.

The liquid driving circuit 20 reverses a polarity of a pixel data signal D corresponding to a video signal "in" relative to a reference voltage Vf for every one horizontal period and feeds the reversed signal to each of the signal lines $X_1, X_2, \ldots, X_n$ in the liquid crystal panel 10 and, at a same time, feeds the scanning signal V in predetermined order to each of the scanning lines $Y_1, Y_2, \ldots, Y_m$ The common voltage generating circuit 30 generates the common voltage Vcom.

In the conventional liquid crystal display device, as shown in FIG. 13, to the liquid crystal panel 10 is applied the common voltage Vcom having a predetermined voltage level and to the liquid crystal driving circuit 20 is applied the reference voltage Vf having a predetermined voltage level and an image corresponding to the pixel data signal D is displayed. The pixel data signal D is reversed relative to the reference voltage Vf for every one horizontal period. Moreover, the common voltage Vcom is adjusted so that flicker occurring due to the reversal of the pixel data signal D can be minimized.

However, the conventional liquid crystal device as described above has following problems. That is, in the conventional technology, in order to minimize flicker, only the common voltage Vcom is calibrated. However, since the common electrode 14 is placed over all areas of the liquid crystal panel 10, due to a voltage drop caused by a resistor component of the common electrode 14, in many cases, the common voltage Vcom is not made uniform over all areas in the liquid crystal panel 10. For this reason, the common voltage Vcom to be used to minimize flicker varies in the liquid crystal panel 10 and, as a result, it is impossible, in some cases, to successfully perform calibration to minimize flicker over all areas of the liquid crystal panel 10. For example, since the common voltage Vcom to be used when flicker occurring in side regions in the liquid crystal panel 10 is minimized is made different from the common voltage Vcom to be used when flicker occurring in regions in a vicinity of a center of the liquid crystal panel 10 is minimized, a phenomenon occurs in which the common voltage Vcom to be used when flicker is minimized over all areas of the liquid crystal panel 10 can not be successfully calibrated. Therefore, a problem arises that display image quality is degraded.

To solve this problem, a liquid crystal device is disclosed in Japanese Patent Application Laid-open No. 2000-305063. The disclosed liquid crystal device is so constructed that a common voltage can be fed from each of the right and left sides in order to enable optimum calibration of flicker at both right and left sides within a face of a liquid crystal panel. It is expected by using this configuration that an optimum common voltage is applied at both the left and right sides of the liquid crystal panel and flicker occurring within the face of the liquid crystal panel is made almost uniform; however, to achieve such the effect, it is necessary to construct the liquid crystal panel so as to have special configurations, which are not readily achieved. Moreover, since a required optimum common voltage is different between portions on both sides of the liquid crystal panel and its central portions, it is difficult to successfully reduce flicker within the face of the liquid crystal panel. When the liquid crystal panel is increased in size in particular, such a tendency becomes remarkable.

SUMMARY OF THE INVENTION

In view of the above, it is an object of the present invention to provide a liquid crystal display device which is capable of reducing flicker over all areas of a liquid crystal panel and a method for driving the liquid crystal device.

According to a first aspect of the present invention, there is provided a liquid crystal display device including:

1. A liquid crystal display device including:

a liquid crystal panel having a first substrate, a second substrate, a liquid crystal layer sandwiched between the first substrate and the second substrate, a plurality of signal lines being formed on the first substrate and to which corresponding pixel data signals are fed, a plurality of scanning lines, being formed on the second substrate orthogonally to the plurality of signal lines and to which a scanning signal is fed, a plurality of pixels each being placed at a point of intersection of each of the signal lines and each of the scanning lines, and one piece of a common electrode being commonly connected to each of the pixels and to which a common voltage is applied;

a liquid crystal driving circuit to reverse a polarity of the pixel data signal corresponding to a video signal relative to a reference voltage for every one horizontal period or for every one vertical period and to apply the reversed pixel data signal to each of the signal lines and to feed the scanning signal to each of the scanning lines in predetermined order;

a common voltage generating circuit to generate the common voltage;

a reference voltage generating circuit to generate the reference voltage so as to have an optimum voltage level that corresponds to a position of each of the pixels in the liquid crystal panel and to feed the generated reference voltage to the liquid crystal driving circuit; and wherein the common voltage generating circuit produces the common voltage as a direct current voltage having a predetermined level and feeds the produced common voltage to the common electrode in the liquid crystal panel.

In the foregoing first aspect, a preferable mode is one wherein the reference voltage generating circuit is so constructed as to change the reference voltage for every plurality of the pixels during one horizontal period of the video signal.

Also, a preferable mode is one wherein the reference voltage generating circuit is so constructed as to change the reference voltage for every plurality of the pixels during one vertical period of the video signal.

Also, a preferable mode is one wherein the reference voltage generating circuit is so configured as to generate the reference voltage such that a higher reference voltage may be applied to the pixels placed in side portions rather than the pixels placed in central portions in the liquid crystal panel.

Also, a preferable mode is one wherein the reference voltage generating circuit is so constructed as to have a look-up-table (LUT) in which a value of the reference voltage corresponding to each of the pixels is stored and as to generate the reference voltage based on the look-up-table.

According to a second aspect of the present invention, there is provided a liquid crystal display device including:

a liquid crystal panel having a first substrate, a second substrate, a liquid crystal layer sandwiched between the first substrate and the second substrate, a plurality of signal lines being formed on the first substrate and to which corresponding pixel data signals are fed, a plurality of scanning lines, being formed on the second substrate orthogonally to the plurality of signal lines and to which a scanning signal is fed, a plurality of pixels each being placed at a point of intersection of each of the signal lines and each of the scanning lines, and one piece of a common electrode being commonly connected to each of the pixels and to which a common voltage is applied;

a liquid crystal driving circuit to reverse a polarity of the pixel data signal corresponding to a video signal relative to a reference voltage for every one horizontal period or for every one vertical period and to apply the reversed pixel data signal to each of the signal lines and to feed the scanning signal to each of the scanning lines in predetermined order;

a common voltage generating circuit to generate the common voltage;

an offset circuit to generate an offset voltage having an optimum voltage level that corresponds to a position of each of the pixels of the liquid crystal panel and, after having added the offset voltage to the video signal, feeds a resulting signal to the liquid crystal driving circuit; and wherein the common voltage generating circuit produces the common voltage as a direct current voltage having a predetermined voltage level and feeds the produced common voltage to the common electrode in the liquid crystal panel.

In the foregoing second aspect, a preferable mode is one wherein the offset circuit is so constructed as to change the offset voltage for every plurality of the pixels during one horizontal period of the video signal.

Also, a preferable mode is one wherein the offset circuit is so constructed as to change the offset voltage for every plurality of the pixels during one vertical period of the video signal.

Also, a preferable mode is one wherein the offset circuit is so configured as to generate the offset voltage such that a higher offset voltage may be applied to the pixels placed in side portions rather than the pixels placed in central portions in the liquid crystal panel.

According to a third aspect of the present invention, there is provided a liquid crystal device driving method for driving a liquid crystal display device including a liquid crystal panel having a first substrate, a second substrate, a liquid crystal layer sandwiched between the first substrate and the second substrate, a plurality of signal lines being formed on the first substrate and to which corresponding pixel data signals are fed, a plurality of scanning lines, being formed on the second substrate orthogonally to the plurality of signal lines and to which a scanning signal is fed, a plurality of pixels each being placed at a point of intersection of each of the signal lines and each of the scanning lines, and one piece of a common electrode being commonly connected to each of the pixels and to which a common voltage is applied; a liquid crystal driving circuit to reverse a polarity of the pixel data signal corresponding to a video signal relative to a reference voltage for every one horizontal period or for every one vertical period and to apply the reversed pixel data signal to each of the signal lines and to feed the scanning signal to each of the scanning lines in predetermined order; and a common voltage generating circuit to generate the common voltage, the method including;

a process of generating the common voltage as a direct current voltage at a predetermined voltage level; and a process of generating the reference voltage so as to have an optimum voltage level that corresponds to a position of each of pixels in the liquid crystal panel and to feed the generated reference voltage to the liquid crystal driving circuit.

In the foregoing third aspect, a preferable mode is one wherein, in the process of generating the reference voltage, the reference voltage is changed for every plurality of the pixels during one horizontal period of the video signal.

Also, a preferable mode is one wherein, in the process of generating the reference voltage, the reference voltage is changed for every plurality of the pixels during one vertical period of the video signal.

Also, a preferable mode is one wherein, in said process of generating said reference voltage, said reference voltage is generated such that a higher reference voltage may be applied to said pixels placed in side portions rather than said pixels placed in central portions in the liquid crystal panel.

According to a fourth aspect of the present invention, there is provided a liquid crystal device driving method for driving a liquid crystal display device including a liquid crystal panel having a first substrate, a second substrate, a liquid crystal layer sandwiched between the first substrate and the second substrate, a plurality of signal lines being formed on the first substrate and to which corresponding pixel data signals are fed, a plurality of scanning lines, being formed on the second substrate orthogonally to the plurality of signal lines and to which a scanning signal is fed, a plurality of pixels each being placed at a point of intersection of each of the signal lines and each of the scanning lines, and one piece of a common electrode being commonly connected to each of the pixels and to which a common voltage is applied; a liquid crystal driving circuit to reverse a polarity of the pixel data signal corresponding to a video signal relative to a reference voltage for every one horizontal period or for every one vertical period and to apply the reversed pixel data signal to each of the signal lines and to feed the scanning signal to each of the scanning lines in predetermined order; and a common voltage generating circuit to generate the common voltage, the method including;

a process of generating the common voltage as a direct current voltage at a predetermined voltage level; and a process of generating an offset voltage having an optimum voltage level that corresponds to a position of each of the pixels in the liquid crystal panel and, after having added the offset voltage to the video signal, feeds a resulting signal to the liquid crystal driving circuit.

In the foregoing fourth aspect, a preferable mode is one wherein, in the process of generating the offset voltage, the offset voltage is changed for every plurality of the pixels during the one horizontal period of the video signal.

Also, a preferable mode is one wherein, in the process of generating the offset voltage, the offset voltage is changed for every plurality of the pixels during the one vertical period of the video signal.

Furthermore, a preferable mode is one wherein, in said process of generating said offset voltage, said offset voltage is generated such that a higher offset voltage may be applied to said pixels placed in side portions rather than said pixels placed in central portions in the liquid crystal panel.

With the above configurations, since a reference voltage is generated so as to have an optimum voltage level that corresponds to a position of each of pixels in a liquid crystal panel and is fed to a liquid crystal driving circuit, even if a common voltage is not made uniform through entire portions of a common electrode, adjustment can be achieved so that flicker is minimized over all areas in the liquid crystal panel.

With another configuration as above, since a reference voltage generating circuit is provided with an LUT and a value of a reference voltage corresponding to each liquid crystal is stored in the LUT, a reference voltage precisely adjusted by a simpler configuration can be acquired and adjustment can be achieved so as to reduce flicker over all areas of the liquid crystal panel.

With still another configuration as above, since a video signal whose offset voltage has been adjusted so as to have an optimum voltage level that corresponds to a position of each of pixels, even if a common voltage is not made uniform through entire portions of the common electrode, adjustment can be achieved so that flicker is minimized over all areas of the liquid crystal panel.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

Figure 1:
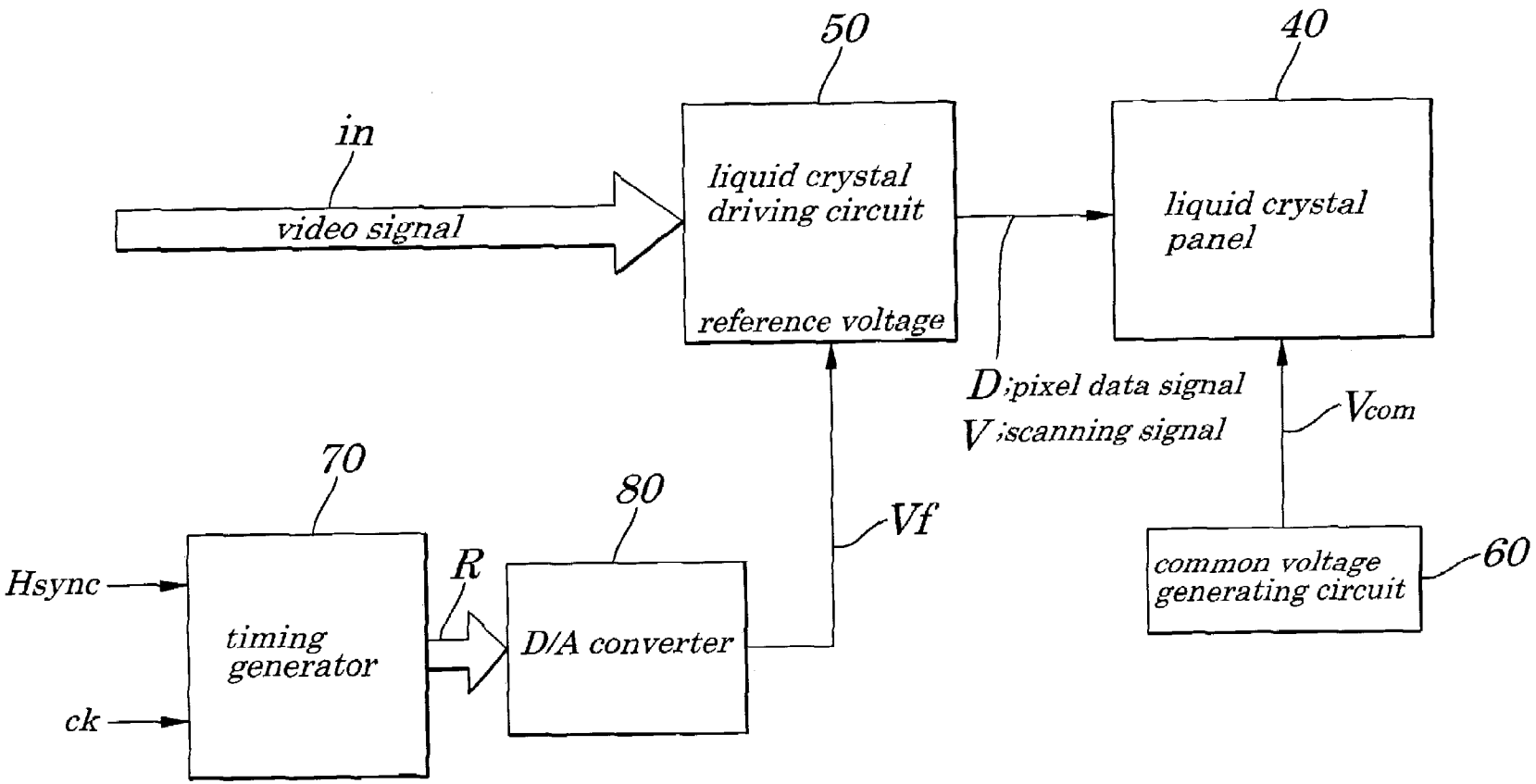
FIG. 1 is a schematic block diagram showing electrical configurations of a liquid crystal display device according to a first embodiment of the present invention.
Figure 2:
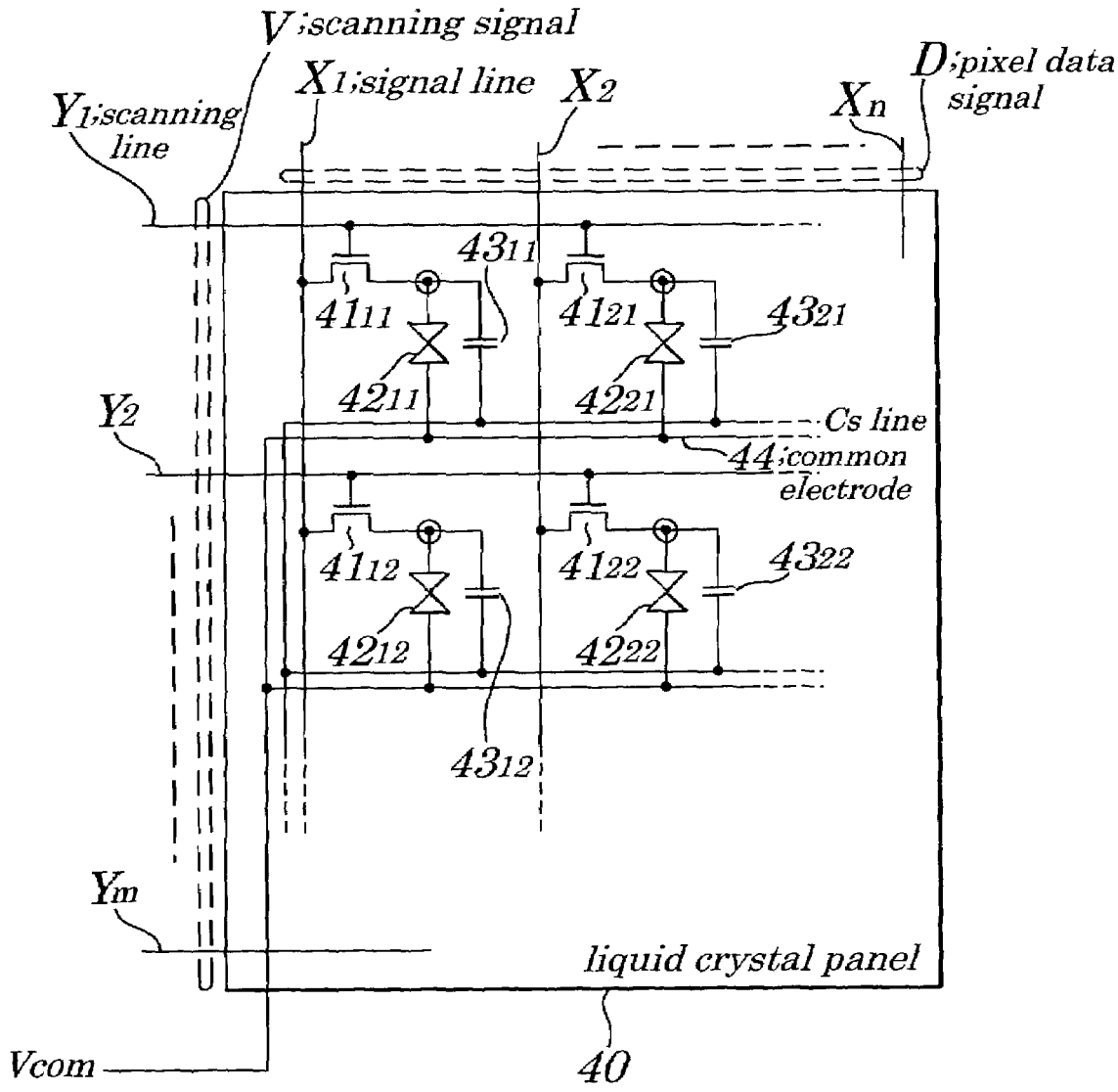
FIG. 2 is a diagram showing electrical configurations of a liquid crystal panel shown in FIG. 1.

FIG. 1 is a schematic block diagram showing electrical configurations of a liquid crystal display device according to a first embodiment of the present invention. The liquid crystal display device of the first embodiment, as shown in FIG. 1, includes a liquid crystal panel 40, a liquid crystal driving circuit 50, a common voltage generating circuit 60, a timing generator 70, and a DA (Digital/Analog) converter 80. The liquid crystal panel 40, as shown in FIG. 2, has a plurality of signal lines $X_1, X_2, \ldots, X_n$ to which a corresponding pixel data signal D is fed, a plurality of scanning lines $Y_1, Y_2, \ldots, Y_m$ to which a scanning signal V is applied, a plurality of MOSFETs (Metal Oxide Semiconductor Effect Field Transistors) $\mathbf{41}_{ij}$ (i=1, 2, . . . , n; j=1, 2, . . . , m) being placed at a point of intersection of each of the signal lines $X_1, X_2, \ldots, X_n$ and each of the scanning lines $Y_1, Y_2, \ldots, Y_m$, pixels $\mathbf{42}_{ij}$ (i=1, 2, . . . , n; j=1, 2, . . . , m), capacitors $\mathbf{43}_{ij}$ (i=1, 2, . . . , n; j=1, 2, . . . , m), Cs line being commonly connected to each of the capacitors $\mathbf{43}_{ij}$, and a common electrode 44 being connected commonly to each of the pixels $\mathbf{42}_{ij}$ to which a common voltage Vcom is applied and in which an image is displayed by feeding a pixel data signal D to the pixels $\mathbf{42}_{ij}$ on the scanning lines $Y_1, Y_2, \ldots, Y_m$ to be selected by the scanning signal V.

The liquid crystal driving circuit 50 reverses a polarity of a pixel data signal D corresponding to a video signal "in" relative to a reference voltage Vf for every one horizontal period and feeds the reversed signal to each of the signal lines $X_1, X_2, \ldots, X_n$ in the liquid crystal panel 40 and, at a same time, feeds the scanning signal V in predetermined order to each of the scanning lines $Y_1, Y_2, \ldots, Y_m$. The common voltage generating circuit 60 generates a common voltage Vcom as a DC (Direct Current) voltage having a predetermined level. The timing generator 70 generates reference voltages (digital value) R each having a different voltage level corresponding to a position of each of the pixels $\mathbf{42}_{ij}$ in the liquid crystal panel 40 and is constructed, in the first embodiment in particular, so as to change the reference voltages R for every plurality of pixels $42_{ij}$ during one horizontal period of the video signal "in". The DA converter 80 performs D/A conversion on the reference voltage (digital value) R and feeds the reference voltage Vf represented by an analog value to the liquid crystal driving circuit 50.

Figure 3:
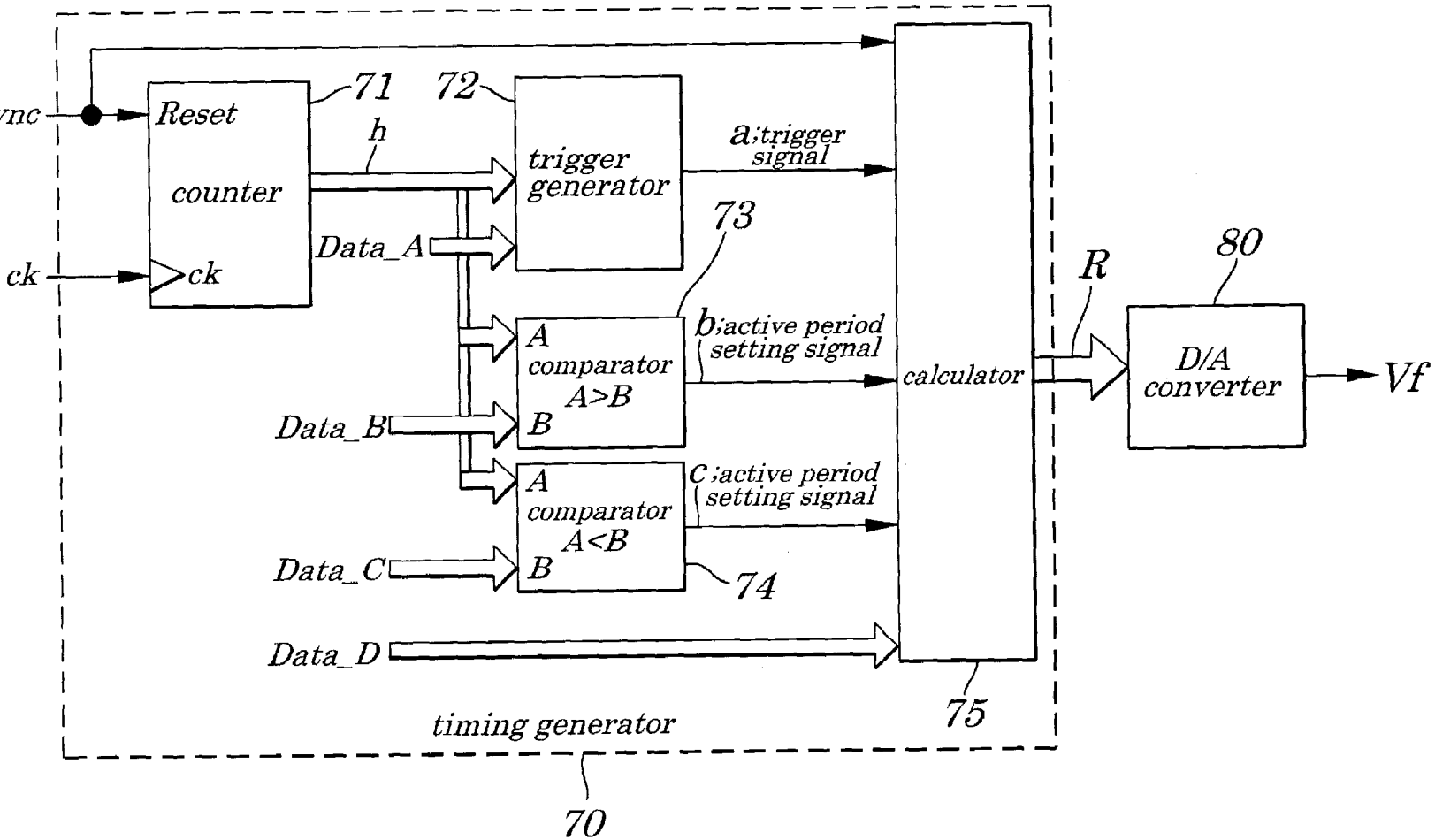
FIG. 3 is a block diagram showing electrical configurations of a timing generator shown in FIG. 1.

FIG. 3 is a block diagram showing electrical configurations of the timing generator 70 shown in FIG. 1. The timing generator 70, as shown in FIG. 3, is made up of a counter 71, a trigger generator 72, comparators 73 and 74, and a calculator 75. The counter 71 uses a horizontal sync signal "$H_{sync}$" as a reference for a resetting operation and counts pixel clocks of the video signal "in" as a clock "ck" and then outputs a resulting count value "h". The trigger generator 72 outputs, based on a count value "h" and "Data_A" (that is, data based mainly on a resolution of the liquid crystal panel 40), a trigger signal "a" at predetermined intervals of time. This predetermined period represents one period during which the trigger generator 72 employed in the liquid crystal panel 40 providing, for example, a resolution according to an XGA (Extended Graphic Array) specification divides pixels 1024 being arranged in a horizontal direction by 64 and outputs the trigger signal "a" for every 16 dots.

The comparator 73 compares the count value "h" with "Data_B" (that is, data based mainly on a resolution of the liquid crystal panel 40) and, if the count value "h" is larger than the "Data_B", outputs a low level (hereinafter may be simply referred to as an "L" level) active period setting signal "b". Also, the comparator 74 compares the count value "h" with "Data_C" (that is, data based mainly on a resolution of the liquid crystal panel 40) and, if the count value "h" is smaller than the "Data_C", outputs an L-level active period setting signal "c". The calculator 75, when the active period setting signal "b" or active period setting signal "c" is output, produces a reference voltage "R" being a value obtained based on "Data_D" (data used to adjust the reference voltage R based on a type of the liquid crystal panel 40).

Figure 4:
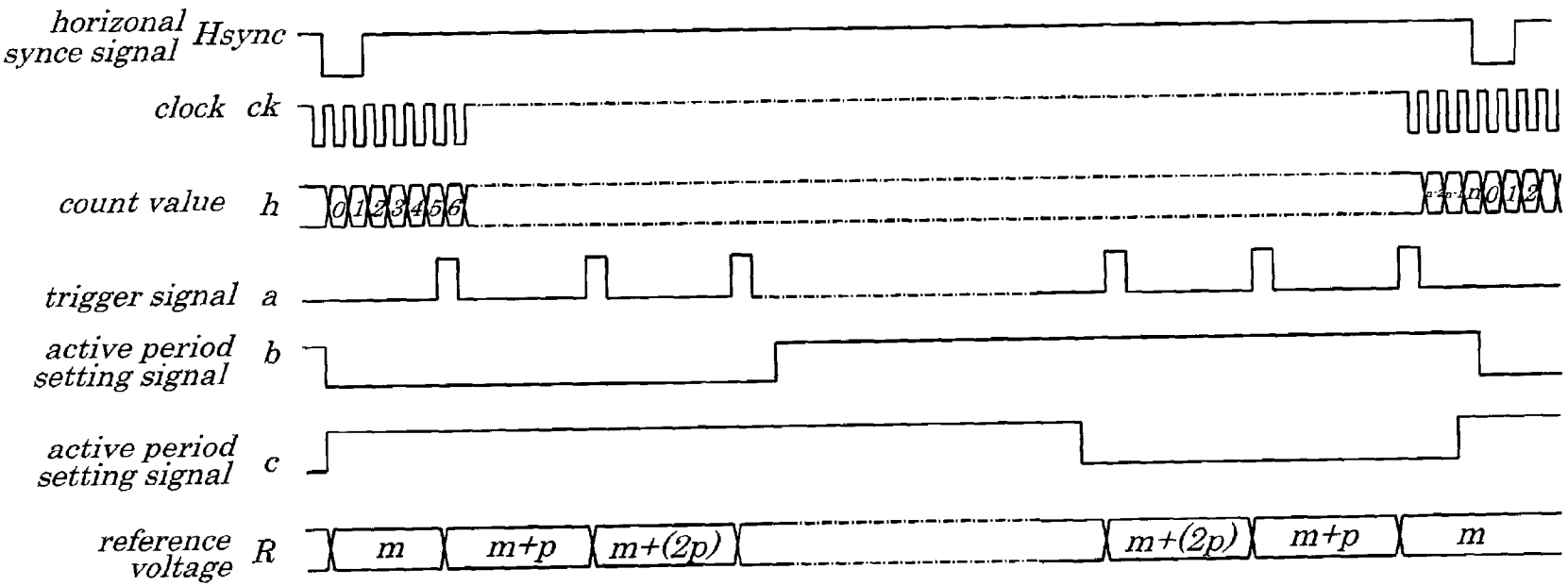
FIG. 4 is a timing chart explaining operations of the timing generator shown in FIG. 3.

FIG. 4 is a timing chart explaining operations of the timing generator 70 shown in FIG. 3. In the timing generator 70, as shown in FIG. 4, a trigger signal (pulse) "a" is output cyclically (for example, every 16 clocks), based on the count value "h" fed from the counter 71, from the trigger generator 72. Then, while the active period setting signal "b" is at an "L" level, the reference voltage R is output as a value occurring every time "p" is added with timing with which the trigger signal "a" is fed in such a manner as "m"→"m+p"→"m+2p"→ . . . . Also, while the active period setting signal "c" is at an "L" level, the reference voltage R is output as a value occurring every time "p" is subtracted with timing with which the trigger signal "a" is fed in such a manner as . . . →"m+2p"→"m+p"→"m". That is, the reference voltage changes as follows:

"m"→"m+p"→"m+2p"→ . . . →"m+2p"→"m+p"→"m"

Figure 5A:
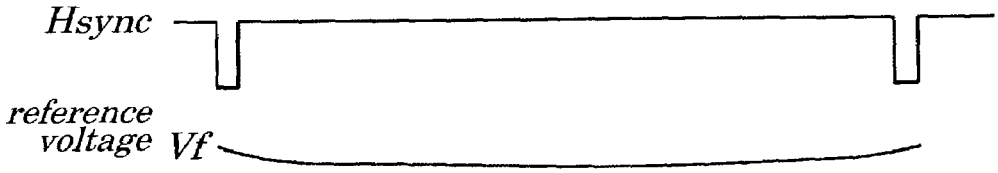
FIGS. 5A and 5B are diagrams illustrating reference voltages to be fed to a liquid crystal driving circuit of the first embodiment of the present invention.
Figure 5B:
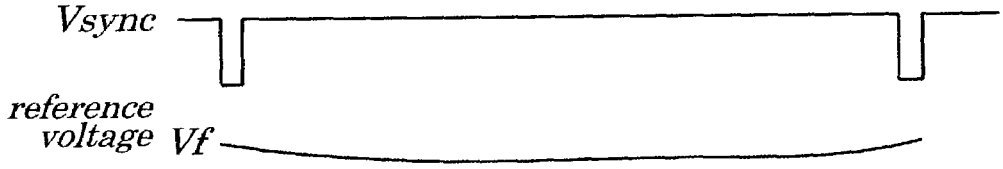

This reference voltage R is D/A (digital to analog) converted by the D/A converter 80 and is output as an analog reference voltage Vf, for example, as shown in FIGS. 5A and 5B, by the DA converter 80. FIG. 5A shows that the reference voltage Vf becomes higher in side regions rather than central regions in the liquid crystal panel 40. FIG. 5B illustrates the reference voltage Vf occurring when a vertical sync signal "$V_{sync}$" instead of the horizontal sync signal "$H_{sync}$" is input to the counter 71 shown in FIG. 3 and also shows that the reference voltage Vf becomes higher in the side regions rather than the central regions in the liquid crystal panel 40.

Figure 6:
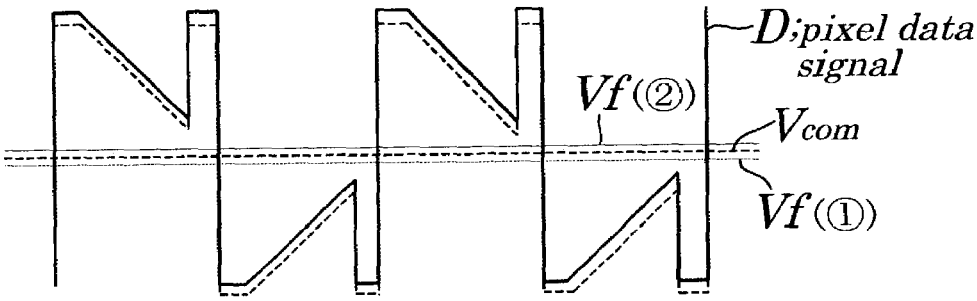
FIG. 6 is a diagram showing a common voltage, reference voltage, and pixel data signal being used in the liquid crystal panel of the first embodiment of the present invention.

FIG. 6 is a diagram showing the common voltage Vcom, the reference voltage Vf, and the pixel data signal D being used in the liquid crystal panel 40 of the first embodiment. A method for driving the liquid crystal panel 40 in the liquid crystal display device of the first embodiment is described by referring to FIG. 6. In the liquid crystal display device of the first embodiment, to the liquid crystal panel 40 is applied the common voltage Vcom having a predetermined level and to the liquid crystal driving circuit 50 is fed the reference voltage Vf from the DA converter 80 (this process is called a "reference voltage generating and feeding processing") and an image corresponding to the pixel data signal D is displayed. The pixel data signal D is reversed relative to the reference voltage Vf every one horizontal period. Moreover, the common voltage Vcom is adjusted so that flicker occurring due to the reversal of the pixel data signal D can be minimized. As shown in FIG. 6, since the reference voltage Vf is higher in side regions (Vf②) rather than in central regions (Vf①) of the liquid crystal panel 40, the pixel data signal D is put into a state as shown by dashed lines in the central regions in the liquid crystal panel 40 and is put into a state as shown by solid lines in the side regions in the liquid crystal panel 40.

Thus, according to the first embodiment, since the reference voltage Vf is generated so as to have an optimum voltage level that corresponds to a position of each of the pixels $42_{ij}$ in the liquid crystal panel 40 and is fed to the liquid crystal driving circuit 50, even if the common voltage Vcom is not made uniform through entire portions of the common electrode 44, adjustment can be achieved so that flicker can be minimized over all areas of the liquid crystal panel 40.

Second Embodiment

Figure 7:
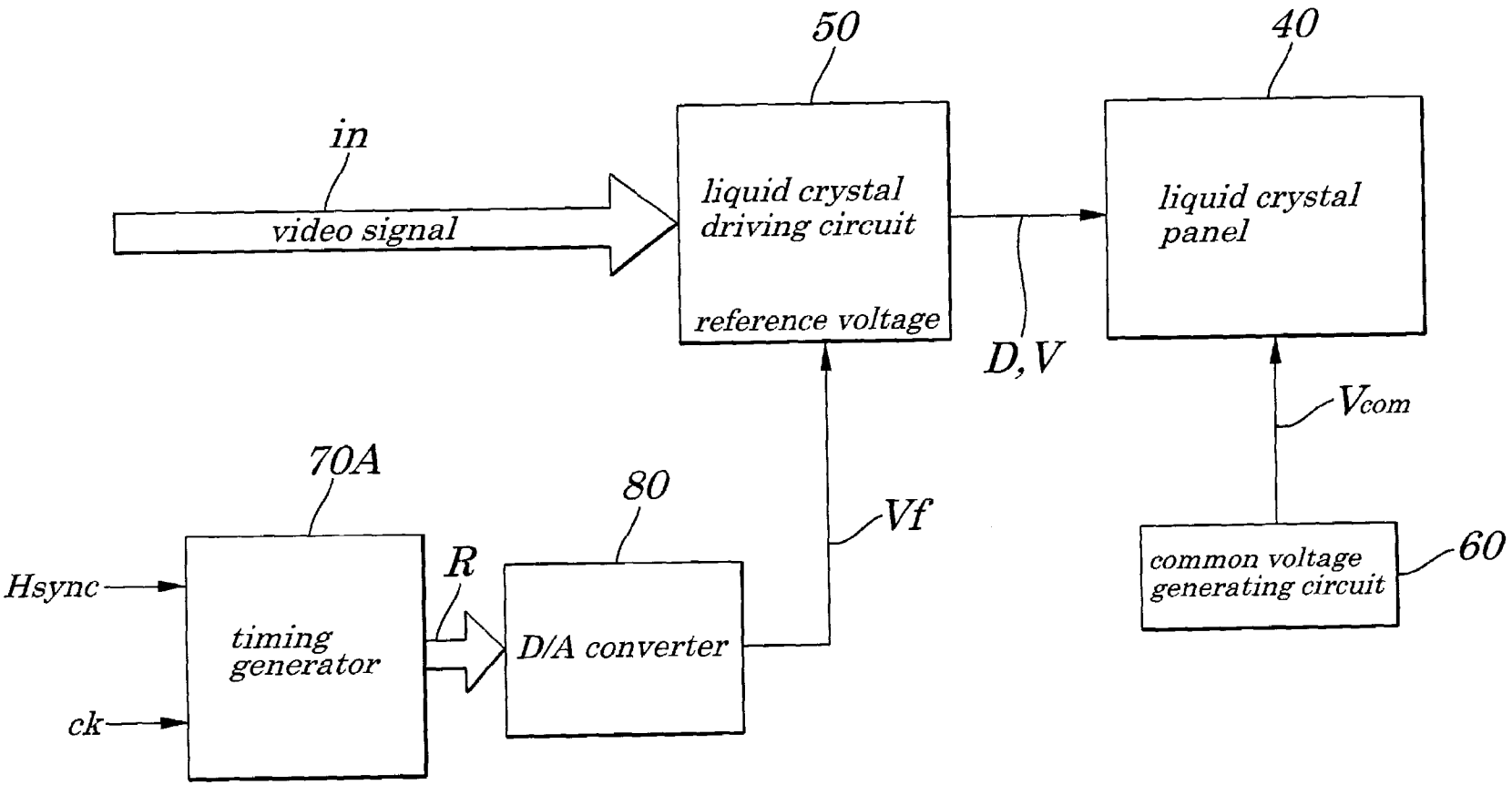
FIG. 7 is a schematic block diagram showing electrical configurations of a liquid crystal display device according to a second embodiment of the present invention.

FIG. 7 is a schematic block diagram showing electrical configurations of a liquid crystal display device according to a second embodiment of the present invention. In FIG. 7, same reference numbers are assigned to components having same functions as in the first embodiment shown in FIG. 1. In the liquid crystal display device of the second embodiment, as shown in FIG. 7, instead of a timing generator 70 shown in FIG. 1, a timing generator 70A having configurations being different from the timing generator 70 is placed.

Figure 8:
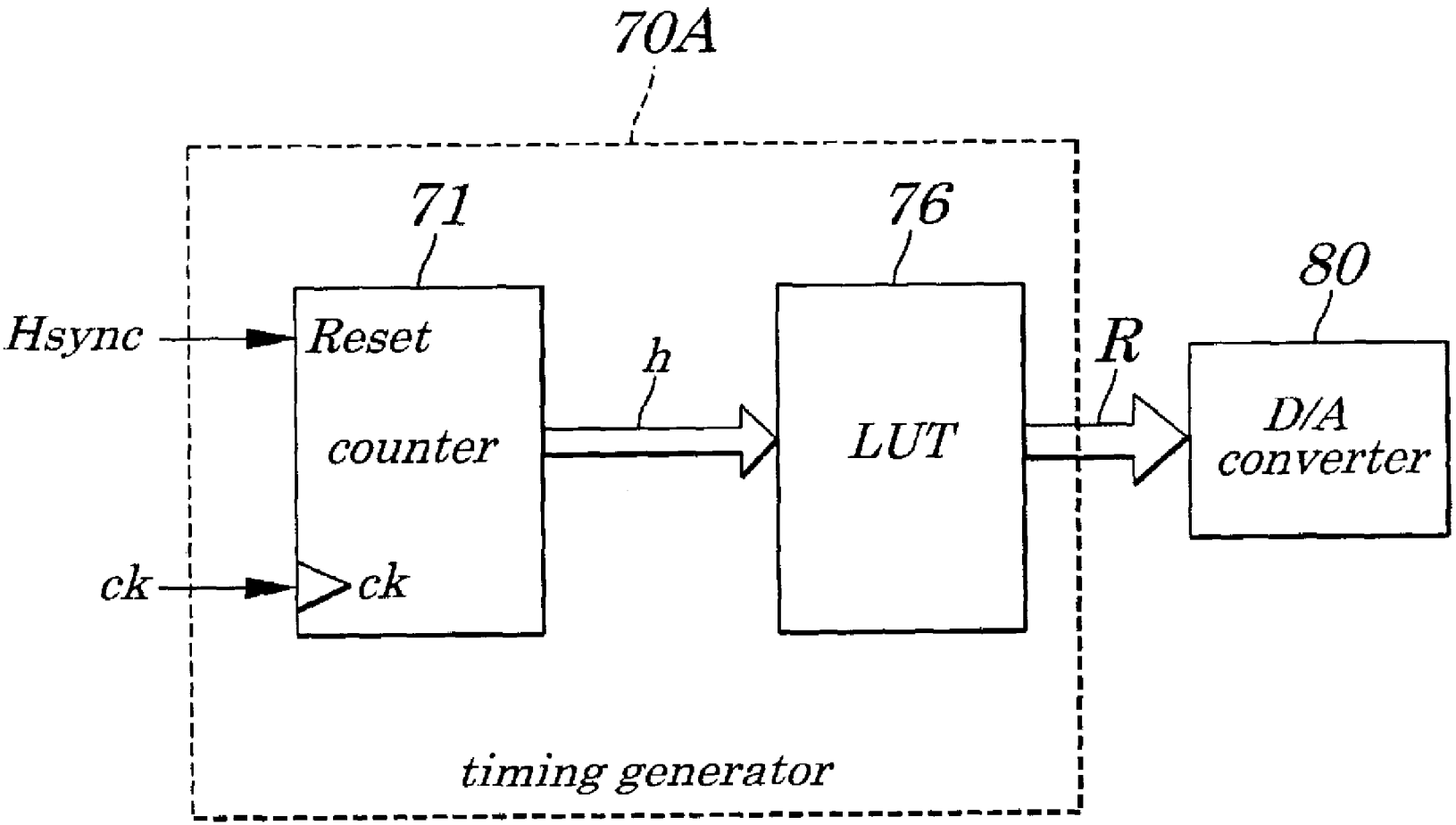
FIG. 8 is a schematic block diagram showing electrical configurations of a timing generator employed in the second embodiment of the present invention.

FIG. 8 is a schematic block diagram showing electrical configurations of the timing generator 70A employed in the second embodiment. In FIG. 8, same reference numbers are assigned to components having same functions as those shown in FIG. 3 in the first embodiment. The timing generator 70A includes a counter 71 and an LUT (Look-Up-Table) 76. The ULT 76 is made up of, for example, a ROM (Read Only Memory), RAM (Random Access Memory), or a like (not shown) and stores values of a reference voltage R corresponding to each of the pixels $42_{ij}$ and outputs the reference voltage R corresponding to a count value "h" output from the counter 71. According to the method for driving a liquid crystal panel of the liquid crystal display device having configurations described above, the reference voltage R corresponding to the count value "h" is output from the LUT 76 and, thereafter, the liquid crystal panel 40 is driven in the same ways as employed in the first embodiment.

Thus, according to the second embodiment, since the LUT 76 is placed in the timing generator 70A and since the reference voltage R corresponding to each of the pixels $42_{ij}$ is stored in the LUT 76, in addition to effects obtained in the first embodiment, additional effects can be achieved that the reference voltage R precisely adjusted by a simpler configuration can be acquired and adjustment can be achieved so as to reduce flicker over all areas of the liquid crystal panel 40.

Third Embodiment

Figure 9:
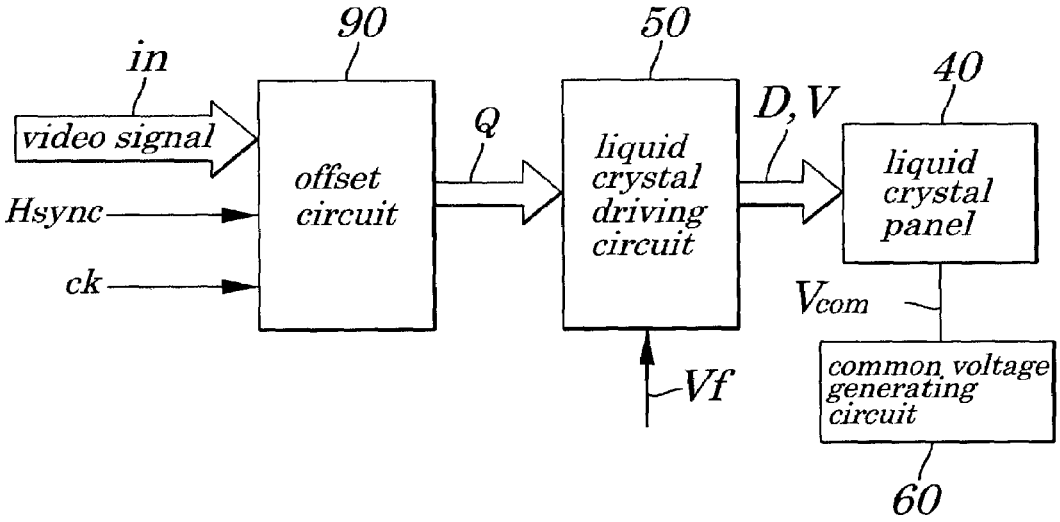
FIG. 9 is a schematic block diagram showing electrical configurations of a liquid crystal display device according to a third embodiment of the present invention.

FIG. 9 is a schematic block diagram showing electrical configurations of a liquid crystal display device according to a third embodiment of the present invention. In FIG. 9, same reference numbers are assigned to components having same functions as in the first embodiment shown in FIG. 1. In the liquid crystal display device of the third embodiment, as shown in FIG. 9, instead of a timing generator 70 and a D/A converter 80 shown in FIG. 1, an offset circuit 90 is newly placed. The offset circuit 90 produces an offset voltage at a level that varies depending on a position of each of pixels $42_{ij}$ in a liquid crystal panel 40 and, in the third embodiment in particular, after having changed the produced offset voltage based on a horizontal sync signal $H_{sync}$ for every plurality of the pixels $42_{ij}$ during one horizontal period of a video signal "in" and then adds a changed offset voltage to the video signal "in" and feeds a resulting signal as a video signal "Q" to a liquid crystal driving circuit 50. Moreover, to the liquid crystal driving circuit 50 is fed a reference voltage Vf having a predetermined level.

Figure 10:
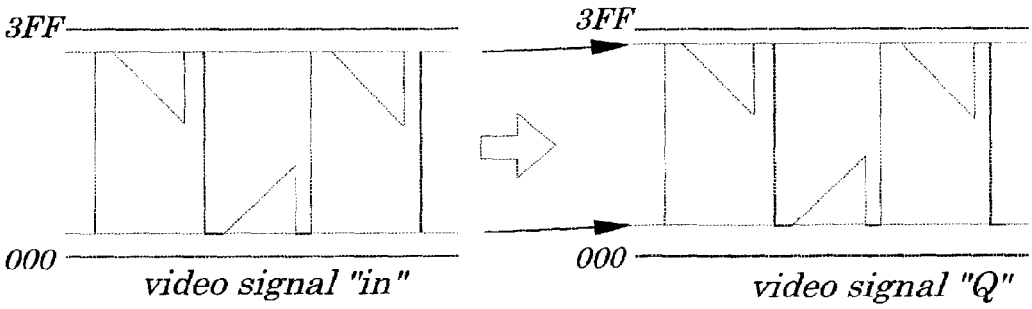
FIG. 10 is a diagram explaining operations of an offset circuit shown in FIG. 9.
Figure 11:
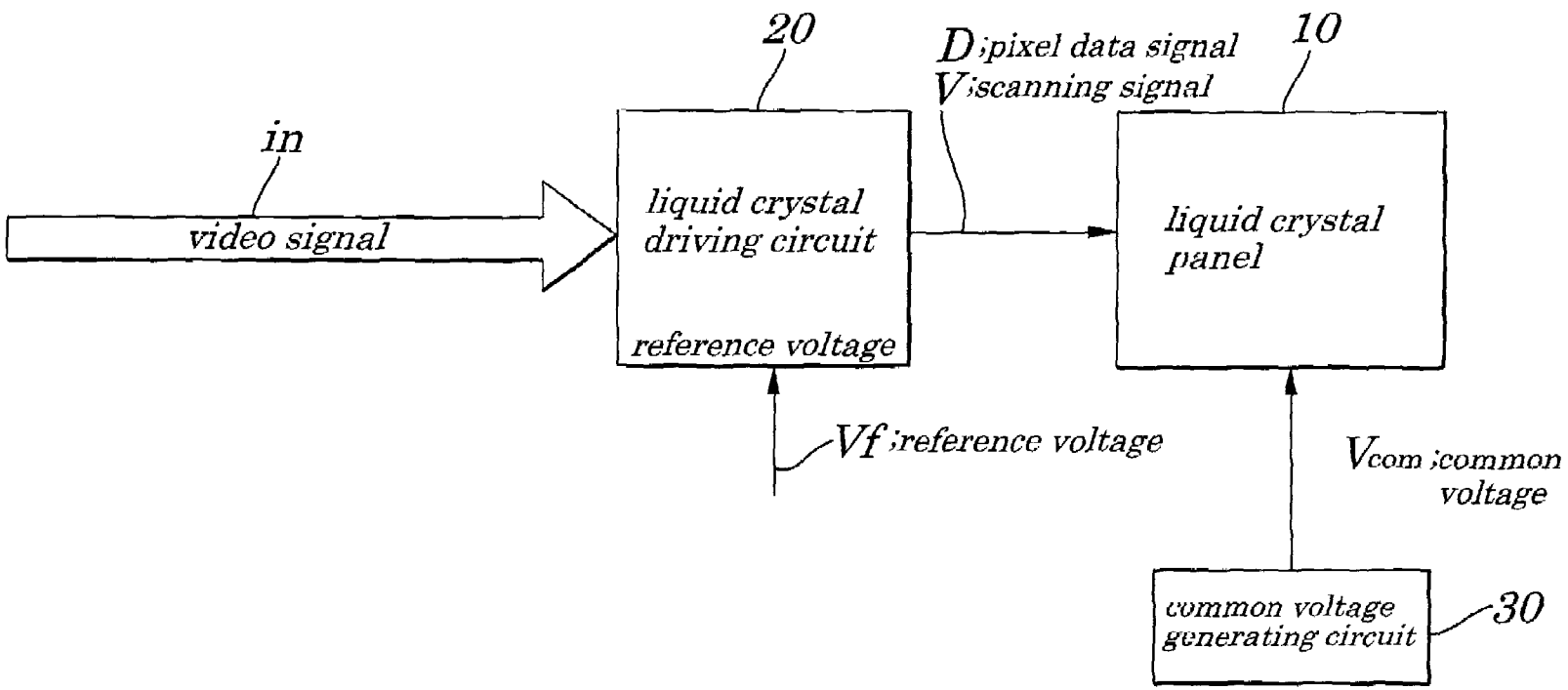
FIG. 11(PRIOR ART)
FIG. 11 is a schematic block diagram showing configurations of a conventional liquid crystal display device.
Figure 12:
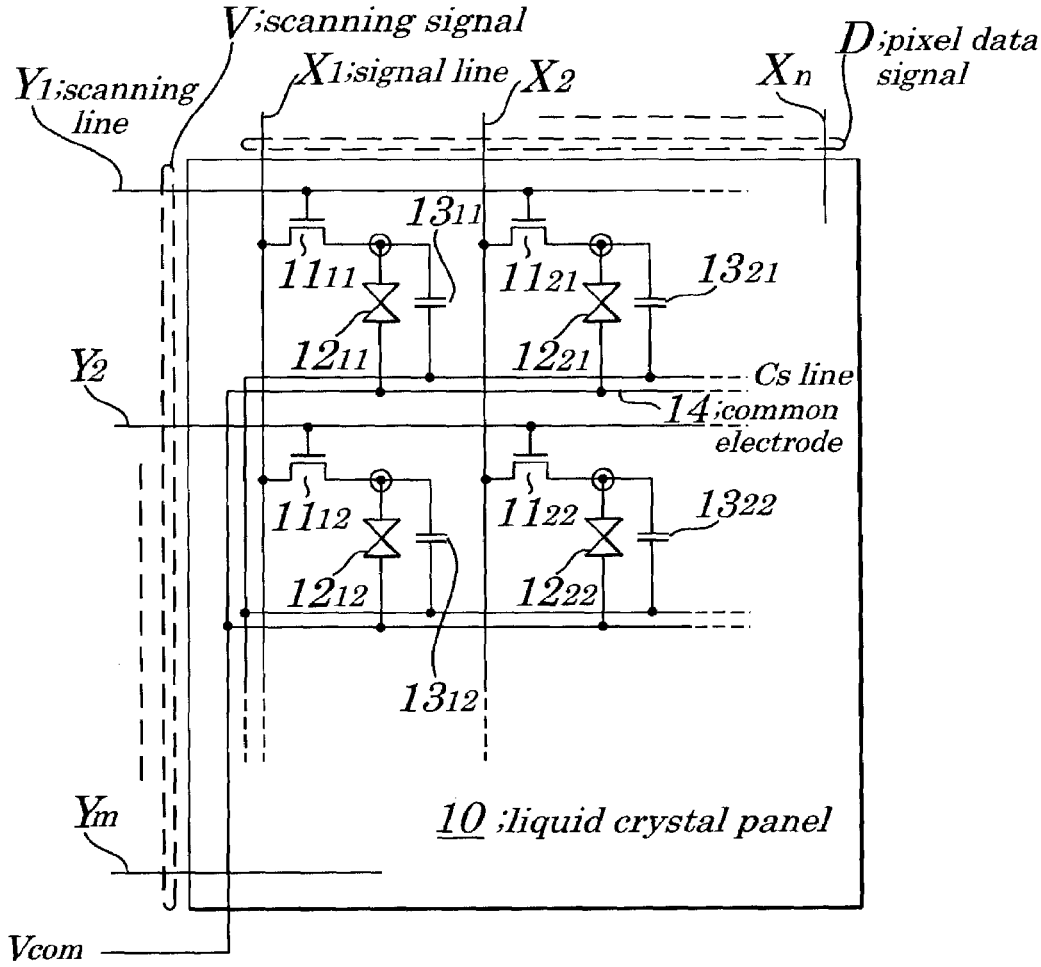
FIG. 12 (PRIOR ART)
FIG. 12 is a diagram showing electrical configurations of a liquid crystal panel shown in FIG. 11.
Figure 13:
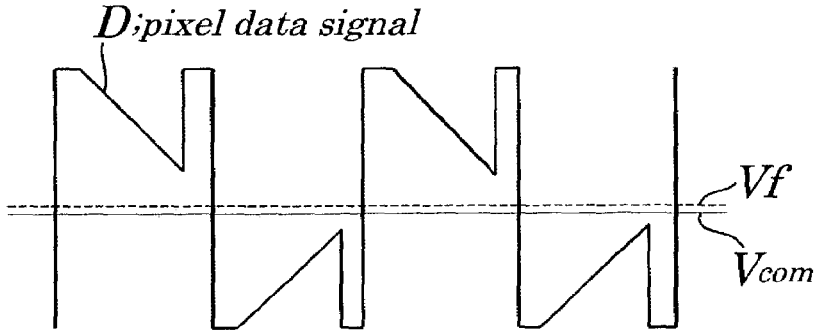
FIG. 13 (PRIOR ART)
FIG. 13 is a diagram showing a common voltage, reference voltage, and pixel data signal being used in the conventional liquid crystal display panel.

FIG. 10 is a diagram explaining operations of the offset circuit 90 shown in FIG. 9. A method for driving the liquid crystal panel 40 of the third embodiment is described by referring to FIG. 10. In the liquid crystal display device of the third embodiment, the reference voltage Vf is set so as to have a predetermined value and, as shown in FIG. 10, the video signal "Q", after its offset voltage has been adjusted so as to have an optimum voltage level that corresponds to a position of each of the pixels $42_{ij}$ during one horizontal period of the video signal "in", is applied to the liquid crystal driving circuit 50. Thereafter, as in the case of the first embodiment, the liquid crystal panel 40 is driven. Moreover, in FIG. 10, waveforms of the video signal "in" and the video signal "Q" represent 10-bit digital data of "000" to "3FF" by analog data.

Thus, according to the third embodiment of the present invention, since the video signal "Q" whose offset voltage has been adjusted so as to have the optimum voltage level that corresponds to a position of each of the pixels $42_{ij}$, even if a common voltage Vcom is not made uniform through entire portions of a common electrode 44 (not shown), adjustment can be achieved so that flicker is minimized over all areas of the liquid crystal panel 40.

It is apparent that the present invention is not limited to the above embodiments but may be changed and modified without departing from the scope and spirit of the invention. For example, the timing generator 70 shown in FIG. 3 may be so constructed that a reference voltage R is changed, by feeding a vertical sync signal $V_{sync}$ instead of a horizontal sync signal $H_{sync}$, for every plurality of the pixels $42_{ij}$ during one vertical period of a video signal "in". Also, the timing generator 70 may be so constructed that a reference voltage R is changed, by feeding a horizontal sync signal $H_{sync}$ and a vertical sync signal $V_{sync}$, for every plurality of the pixels $42_{ij}$ during one horizontal period and one vertical period of a video signal "in". Also, the offset circuit 90 shown in FIG. 9 may be so constructed that an offset voltage contained in a voltage of a video signal "Q" is changed, by feeding a vertical sync signal $V_{sync}$ instead of a horizontal sync signal $H_{sync}$, for every plurality of the pixels $42_{ij}$ during one vertical period of a video signal "in". Also, the offset circuit 90 may be so constructed that an offset voltage contained in a voltage of a video signal "Q" is changed, by feeding a vertical sync signal $V_{sync}$ and a horizontal sync signal $H_{sync}$, for every plurality of the pixels $42_{ij}$ during one horizontal period and one vertical period of a video signal "in".

What is claimed is:

1. A liquid crystal display device comprising:

a liquid crystal panel having a first substrate, a second substrate, a liquid crystal layer sandwiched between said first substrate and said second substrate, a plurality of signal lines being formed on said first substrate and to which corresponding pixel data signals are fed, a plurality of scanning lines, being formed on said second substrate orthogonally to said plurality of signal lines and to which a scanning signal is fed, a plurality of pixels each being placed at a point of intersection of each of said signal lines and each of said scanning lines, and one piece of a common electrode being commonly connected to each of said pixels and to which a common voltage is applied;

a liquid crystal driving circuit to reverse a polarity of said pixel data signals corresponding to video signals relative to a reference voltage for every one horizontal period or for every one vertical period and to apply the reversed pixel data signals to the corresponding signal lines and to feed said scanning signal to each of said scanning lines in predetermined order;

a common voltage generating circuit to generate said common voltage;

a reference voltage generating circuit to generate said reference voltage so as to have an optimum voltage level that corresponds to a position of each of said pixels in said liquid crystal panel and to feed the generated reference voltage to said liquid crystal driving circuit; and wherein said common voltage generating circuit produces said common voltage as a direct current voltage having a predetermined voltage level and feeds the produced common voltage to said common electrode in said liquid crystal panel, wherein said reference voltage generating circuit is so constructed as to have a look-up-table in which a value of said reference voltage corresponding to each of said pixels is stored and as to generate said reference voltage based on said look-up-table.

2. The liquid crystal display device according to claim 1, wherein said reference voltage generating circuit is so constructed as to change said reference voltage for every plurality of said pixels during one horizontal period of said video signal.

3. The liquid crystal display device according to claim 1, wherein said reference voltage generating circuit is so constructed as to change said reference voltage for every plurality of said pixels during one vertical period of said video signal.

4. The liquid crystal display device according to claim 1, wherein said reference voltage generating circuit is so configured as to generate said reference voltage such that a higher reference voltage may be applied to said pixels placed in side portions rather than said pixels placed in central portions in the liquid crystal panel.

5. A liquid crystal device driving method for driving a liquid crystal display device comprising a liquid crystal panel having a first substrate, a second substrate, a liquid crystal layer sandwiched between said first substrate and said second substrate, a plurality of signal lines being formed on said first substrate and to which corresponding pixel data signals are fed, a plurality of scanning lines, being formed on said second substrate orthogonally to said plurality of signal lines and to which a scanning signal is fed, a plurality of pixels each being placed at a point of intersection of each of said signal lines and each of said scanning lines, and one piece of a common electrode being commonly connected to each of said pixels and to which a common voltage is applied; a liquid crystal driving circuit to reverse a polarity of said pixel data signal corresponding to a video signal relative to a reference voltage for every one horizontal period or for every one vertical period and to apply the reversed pixel data signal to each of said signal lines and to feed said scanning signal to each of said scanning lines in predetermined order; and a common voltage generating circuit to generate said common voltage, said method comprising;

a process of generating said common voltage as a direct current voltage having a predetermined voltage level; and a process of generating said reference voltage so as to have an optimum voltage level that corresponds to a position of each of said pixels in said liquid crystal panel and to feed the generated reference voltage to said liquid crystal driving circuit, and storing a value of said reference voltage corresponding to each of said pixels in a look-up table and generating said reference voltage based on said look-up-table.

6. The liquid crystal device driving method according to claim 5, wherein, in said process of generating said reference voltage, said reference voltage is changed for every plurality of said pixels during one horizontal period of said video signal.

7. The liquid crystal device driving method according to claim 5, wherein, in said process of generating said reference voltage, said reference voltage is changed for every plurality of said pixels during one vertical period of said video signal.

8. The liquid crystal display device according to claim 5, wherein, in said process of generating said reference voltage, said reference voltage is generated such that a higher reference voltage may be applied to said pixels placed in side portions rather than said pixels placed in central portions in the liquid crystal panel.

* * * * *